US010851994B2

(12) United States Patent
Fisten et al.

(10) Patent No.: US 10,851,994 B2
(45) Date of Patent: Dec. 1, 2020

(54) ELECTRONIC CIGAR LIGHTER

(71) Applicants: Douglas I. Fisten, Plantation, FL (US); Carl D. Hoff, Weston, FL (US); Daniel Z. Hoff, Weston, FL (US)

(72) Inventors: Douglas I. Fisten, Plantation, FL (US); Carl D. Hoff, Weston, FL (US); Daniel Z. Hoff, Weston, FL (US)

(73) Assignee: Lions' Share Capital Solutions, LLC, Plantation, FL (US)

( * ) Notice: Subject to any disclaimer, the term of this patent is extended or adjusted under 35 U.S.C. 154(b) by 219 days.

(21) Appl. No.: 15/919,743

(22) Filed: Mar. 13, 2018

(65) Prior Publication Data

US 2018/0266685 A1 Sep. 20, 2018

Related U.S. Application Data

(60) Provisional application No. 62/471,107, filed on Mar. 14, 2017, provisional application No. 62/641,478, filed on Mar. 12, 2018.

(51) Int. Cl.
*F23Q 7/16* (2006.01)

(52) U.S. Cl.
CPC ..... *F23Q 7/16* (2013.01)

(58) Field of Classification Search
CPC ..... F23Q 7/16
USPC ..... 219/265, 276, 270; 392/383, 390
See application file for complete search history.

(56) References Cited

U.S. PATENT DOCUMENTS

D46,480 S 9/1914 Lively
1,370,631 A * 3/1921 Clark ..... F23Q 7/00 219/261
1,463,263 A 7/1923 Grayson
1,505,248 A * 8/1924 Extrom ..... F23Q 7/00 219/270
1,605,675 A 11/1926 Mann
2,129,374 A 9/1938 Johnson
2,516,843 A * 8/1950 Bakst ..... F23Q 7/16 219/268
2,537,710 A 1/1951 Schroeder
2,605,380 A 7/1952 Bauman
2,975,262 A 9/1952 Schnick
2,672,547 A 3/1954 Schroeder
2,748,246 A 10/1954 Lewis
2,993,977 A * 7/1961 Balaguer ..... F23Q 7/16 219/270
3,007,027 A 10/1961 Hall
(Continued)

FOREIGN PATENT DOCUMENTS

CN 201306737 Y * 9/2009
CN 101852445 A * 10/2010

OTHER PUBLICATIONS http://www.dhgate.com/reviews/electric-cigar-lighter-reviews.html This internet site shows reviews of electronic cigar lighters that are currently commercially available.

*Primary Examiner* — Thien S Tran

(74) *Attorney, Agent, or Firm* — Robert M. Schwartz; Alfred Dassler

(57) ABSTRACT

An electric cigar lighter for lighting a cigar having an electrical power supply with positive and negative terminals attachable to a tubular body, the battery disposed in the body, and a resistor plate connected to the electrical power supply, the resistor plate defining a plurality of parallel circuits connected in series with one another.

17 Claims, 16 Drawing Sheets

(56) References Cited

U.S. PATENT DOCUMENTS

| | | | | | |
|---|---|---|---|---|---|
| 3,125,662 | A | | 3/1964 | Alvarez | |
| 3,393,293 | A | | 7/1968 | Jacobson | |
| 3,419,704 | A | * | 12/1968 | Hunt | F23Q 7/00 219/268 |
| 3,419,705 | A | | 12/1968 | Gordon | |
| 4,429,212 | A | | 1/1984 | Mock | |
| D313,072 | S | | 12/1990 | Welsh et al. | |
| 5,039,840 | A | | 8/1991 | Boardman | |
| 5,235,157 | A | | 8/1993 | Blackburn | |
| 5,274,214 | A | * | 12/1993 | Blackburn | F23Q 7/16 219/267 |
| 5,285,050 | A | | 2/1994 | Blackburn | |
| 5,354,968 | A | | 10/1994 | Yamamura | |
| 5,380,984 | A | * | 1/1995 | Yamamura | F23Q 7/16 219/270 |
| 5,530,225 | A | | 6/1996 | Hajaligol | |
| 5,649,554 | A | * | 7/1997 | Sprinkel | A24F 47/008 128/202.21 |
| D517,204 | S | | 3/2006 | Dodo et al. | |
| 7,586,063 | B1 | | 9/2009 | Wilbon | |
| 7,791,002 | B2 | | 9/2010 | Muska et al. | |
| 8,371,709 | B2 | | 2/2013 | Cheng | |
| 8,481,892 | B2 | | 7/2013 | Nakamura | |
| 2003/0226837 | A1 | | 12/2003 | Blake | |
| 2006/0060575 | A1 | | 3/2006 | Lindsey et al. | |
| 2010/0301032 | A1 | | 12/2010 | Johnson | |
| 2012/0080042 | A1 | | 4/2012 | Nishimura | |
| 2012/0193343 | A1 | | 8/2012 | Johnson | |
| 2013/0255702 | A1 | | 10/2013 | Griffith | |
| 2015/0159869 | A1 | | 6/2015 | Stevenson | |
| 2015/0189053 | A1 | | 7/2015 | LaHam | |
| 2016/0010861 | A1 | | 1/2016 | Huntley | |
| 2017/0035112 | A1 | * | 2/2017 | Thorens | A24F 47/008 |

* cited by examiner

ELECTRONIC CIGAR LIGHTER

INDEX TO RELATED APPLICATIONS

This application claims the benefit of U.S. Provisional Application Ser. No. 62/471,107, filed on Mar. 14, 2017, entitled Electronic Cigar Lighter, and U.S. Provisional Application Ser. No. 62/641,478, filed Mar. 12, 2018, entitled Electronic Cigar Lighter, the prior applications are herewith incorporated by reference in its entirety.

BACKGROUND OF THE INVENTION

The present invention relates to an electronic cigar lighter, a portable device to ignite a combustible material and specifically to light a cigar. Cigars in comparison to cigarettes for example are more robust, thicker, longer, and have a larger diameter, cross sectional circular area and volume to be lit when lighting the cigar. For example, there are portable electronic devices to light cigarettes. Cigarettes typically have a smaller cross-section or diameter, smaller cross sectional circular area and volume, and thus would be relatively easy to ignite or light. However, cigars with a larger volume and cross section or diameter are more difficult to ignite or light. Heretofore, electronic cigar lighters were incapable of repeatedly lighting and relighting a cigar, because of insufficient power to heat a lighter or that the lighter portion, typically a metal wire, was not strong enough or powerful enough to ignite the cigar.

BRIEF SUMMARY OF THE INVENTION

The present invention is an electronic cigar lighter that includes two main parts, first, a standard battery that is commonly used with the manufacture of other electronic portable devices such as vaporizers, and second, a uniquely designed, replaceable heater referred to as the "burner plate."

In use, a button is pressed and held in the on position to cause the battery to initiate an electric current to the burner plate. The resistance caused by the flow of electrical current through the burner plate causes the burner plate to heat up. The burner plate has a specially designed one (1) inch circumference, to accommodate a full-sized cigar. This allows the longitudinal end face of the cigar surface to be put in direct contact with the burner plate to be lit quickly, easily, and evenly without the use of an open flame, butane, or other combustible liquid-powered material. This represents a significant improvement in performance in a lighter specifically targeted at the larger and more difficult to light surface of most commercial cigars on the market today.

The electronic cigar lighter device functions like a pocket-sized electric grill. Typically, the electronic cigar lighter will heat up to a desired temperature in under three (3) seconds. The second component, the burner plate, allows electricity to flow quickly and evenly throughout the burner plate to heat quickly and evenly to ignite a full-size cigar without draining too much power from the battery, while allowing for multiple uses before it is necessary to recharge the battery.

The burner plate/heating wire is enclosed by a brass cover with side vents to allow air into the unit in order to have improved combustion for lighting the cigar as well as allowing the burner plate to allow the heat to dissipate and cool down quicker after use. The burner plate is mounted to the brass cover using a steady pin that also connects the positive and negative poles which allows current to pass through the heating wire from the battery. A bottom body is used to offer additional support when held by the user and allow the positive pole to pass through it for battery contact. The battery contact has a 510 internal thread (as known in the art) which allows it to receive one of several battery types readily available on the market.

The heating wire is made of material FeCrAL which is an iron chromium aluminum mix, without nickel. The resistance of the wire/burner plate is 0.24 ohms.

The battery has 5-click on 5-click off safety lock and an internal overheat prevention circuit with a 10 second cutoff.

It is accordingly an object of the invention to provide a cigar lighter which overcomes the disadvantages of the heretofore-known devices and methods of this general type and which provides a safe efficient cigar lighter.

With the foregoing and other objects in view there is provided a cigar lighter including a tubular body, an electrical power supply disposed in the body, a resistor plate connected to the electrical power supply, the resistor plate defining a plurality of parallel circuits connected in series with one another.

In accordance with another feature of the invention the main body has a positive pole and a negative pole connecting the resistor plate to the electrical power supply.

In accordance with an added feature of the invention, the resistor plate has two flanges, and each of the poles has a slot formed therein for receiving a respective one of the two flanges.

In accordance with an additional feature of the invention is a screw connecting the positive pole to the main body and electrically connecting the positive pole to the power supply, the screw being electrically disconnected from the main body.

In accordance with yet an additional feature of the invention, is an electrically insulating spacer disposed between the positive pole and the main body for insulating the positive pole from the main body.

In accordance with yet another added feature of the invention the spacer spaces the screw from a through hole in the main body.

In accordance with still another feature of the invention is a cigar lighter having a sleeve having a circumferential wall, a first longitudinal end and a second longitudinal end; a planar heating element disposed in the sleeve, the heating element having an exposed face for engaging and lighting a cigar, an electrical power supply disposed at the second longitudinal end and being connected to the heating element, the circumferential wall having an opening formed therein between the heating element and the second longitudinal end, the opening being fluidically connected to an underside of the heating element.

In accordance with an added feature of the invention is a continuous air gap about a circumference of the heating element between the heating element and the circumferential wall.

In accordance with yet another feature of the invention is a cigar lighter having a body, a first pole, a second pole, an electrical power supply disposed in the body, a resistor plate connecting the first pole to the second pole, the resistor plate defining a plurality of current paths separating from one another at the first and second poles.

In accordance with still another feature of the invention is a cigar lighter having a body, a first pole, a second pole, a resistor plate having a circumferential edge, the resister plate connecting the first pole to the second pole, the resistor plate defining a plurality of current paths between the first pole and the second pole, individual current paths of said plurality of current paths separating from one another at the circumferential edge.

In accordance with yet still another feature of the invention is a cigar lighter having a body, a first pole, a second pole, an electrical power supply disposed in the body, a resistor plate connecting the first pole to the second pole, the plate having a plurality of through apertures formed therein, the plurality of apertures defining a plurality of adjacent current paths between the first and second poles.

In accordance with still another feature of the invention is a cigar lighter having a body, an electrical power supply disposed in the body, a first pole disposed on the body, a second pole disposed on the body 180° from the first pole, a resistor plate having a matched pair of current paths with a first half of the pair being symmetric to a second half of the pair about a line between the first and the second poles.

In accordance with yet another feature of the invention is a cigar lighter having a body, an electric power supply disposed in the body, a first pole disposed on the body, a second pole disposed on the body opposite the first pole, a resistor plate having a grid pattern defining two primary current paths of equal length from the first pole to the second pole and a secondary current path from the first pole to the second pole, a length of each of the two primary current paths being less than a length of the secondary current path.

In accordance with yet another feature of the invention is a cigar lighter having a battery having positive and negative terminals attachable to a body portion, the body portion having a peripheral wall, the peripheral wall having one or more vent openings therein, a mounting plate within the peripheral wall and the body portion, the body portion having a cylindrical center opening there through, a positive pole having a slotted portion and an opening for receiving a threaded screw, the screw mounted through the cylindrical opening and electrically insulated from the mounting plate, the threaded screw in electrical contact with the positive terminal of the battery, and a negative pole having a slotted portion mounted on the mounting plate and separated from the positive pole, the mounting plate in electrical contact with the negative terminal of the battery, a high resistance heating wire having a pair of separated flanges, one of the flanges connected to the slot in the positive pole and the other flange connected to the slot in the negative pole, and an electrical circuit connecting the battery, the switch, the positive pole, the heating wire and the negative pole in series, such that when the electrical circuit is closed, heat is generated by the resistance of the heating wire.

Other features which are considered as characteristic for the invention are set forth in the appended claims.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENT

Figure 1A:
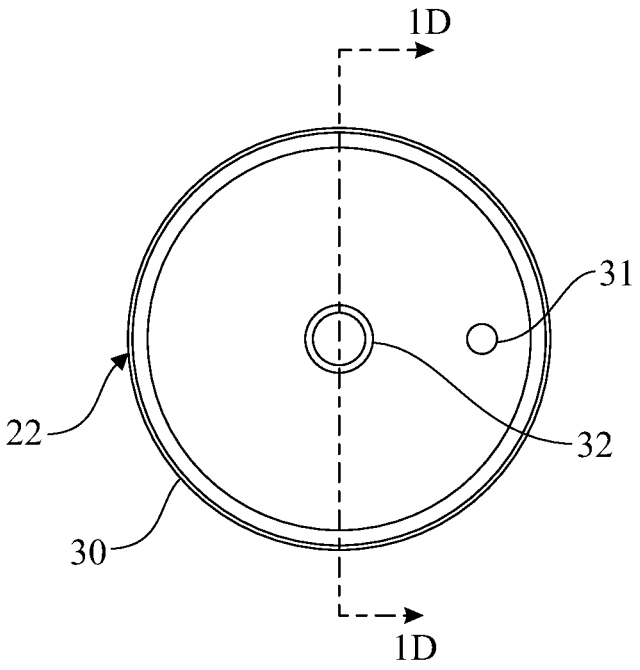
FIG. 1A is a plan view of the main body of the present invention of an electronic cigar lighter.
Figure 1B:
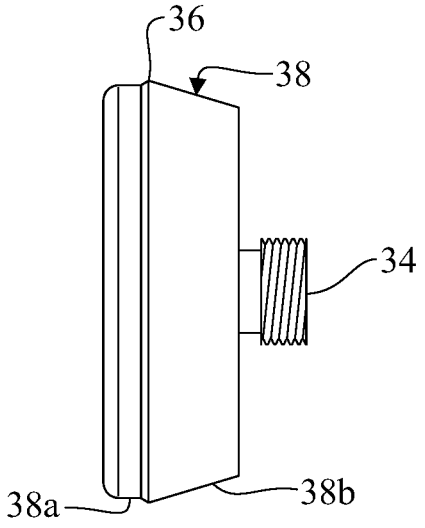
FIG. 1B is a side view of the main body.
Figure 1C:
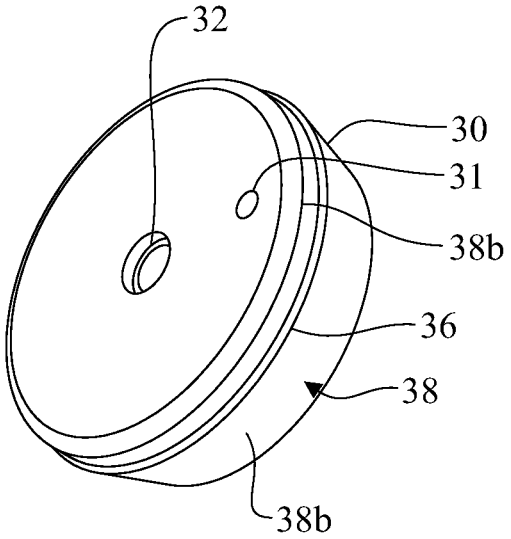
FIG. 1C is a perspective view of the main body.
Figure 1D:
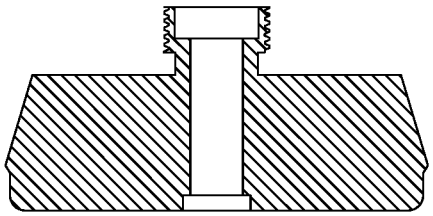
FIG. 1D is a cross sectional view of the main body.
Figure 2A:
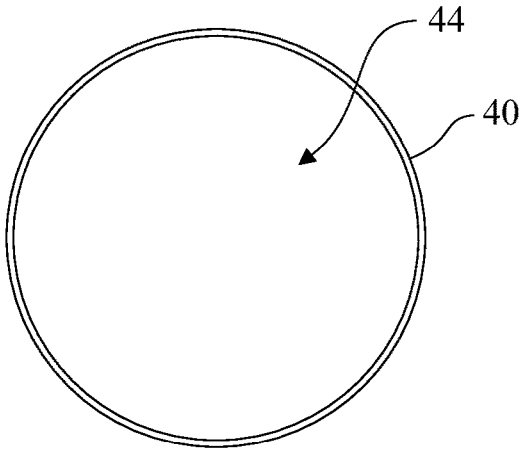
FIG. 2A is a top view of the cover.
Figure 2B:
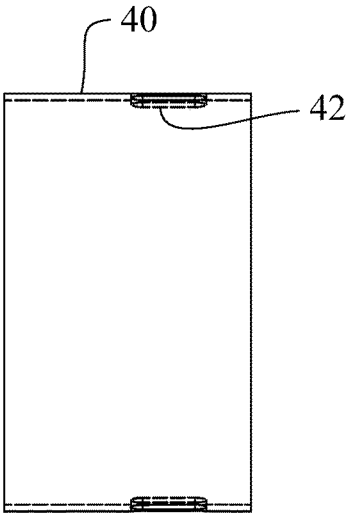
FIG. 2B is a side view of the cover.
Figure 2C:
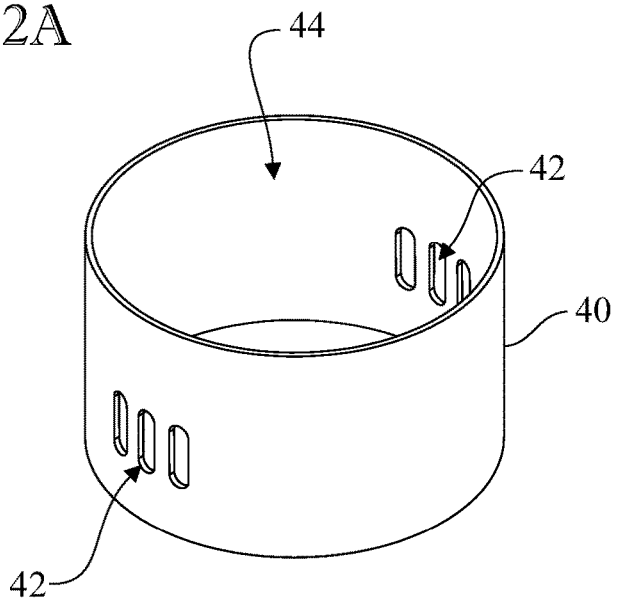
FIG. 2C is a perspective view of the cover.
Figure 2D:
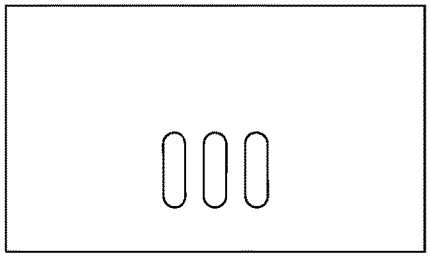
FIG. 2D is a side view of the cover.
Figure 3A:
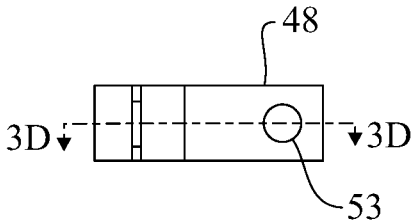
FIG. 3A is a top view of the positive pole.
Figure 3B:
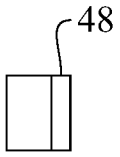
FIG. 3B is a bottom view of the positive pole.
Figure 3C:
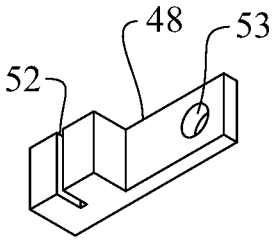
FIG. 3C is a perspective view of the positive pole.
Figure 3D:
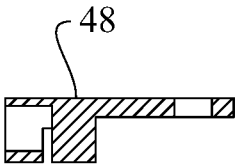
FIG. 3D is a cross sectional view of the positive pole.
Figure 4A:
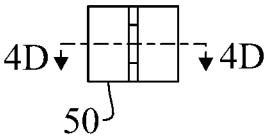
FIG. 4A is a front view of the negative pole.
Figure 4B:
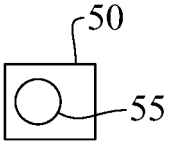
FIG. 4B is a top view of the negative pole.
Figure 4C:
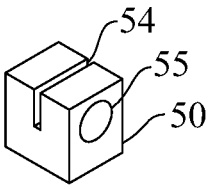
FIG. 4C is a perspective view of the negative pole.
Figure 4D:
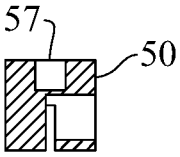
FIG. 4D is a cross sectional view of the negative pole.
Figure 5A:
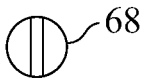
FIG. 5A is a bottom view of the positive pole.
Figure 5B:
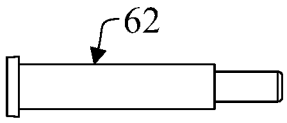
FIG. 5B is a side view of the positive pole.
Figure 5C:
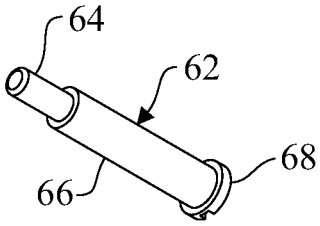
FIG. 5C is a perspective view of the positive pole.
Figure 5D:
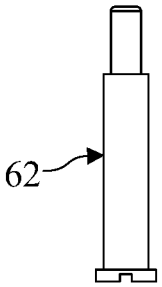
FIG. 5D is a cross sectional view of the positive pole.
Figure 5E:
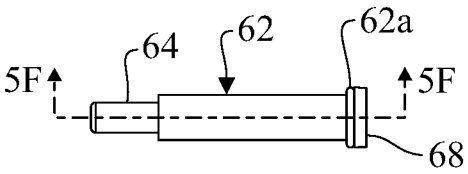
FIG. 5E is a side view of the positive pole with a washer.
Figure 5F:
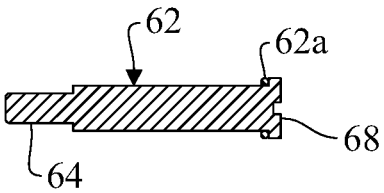
FIG. 5F is a sectional view of the positive pole with a washer taken along lines 5F-5F of FIG. 5E.
Figure 6A:
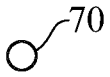
FIG. 6A is a bottom view of the steady pin.
Figure 6B:
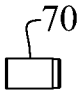
FIG. 6B is a side view of the steady pin.
Figure 6C:
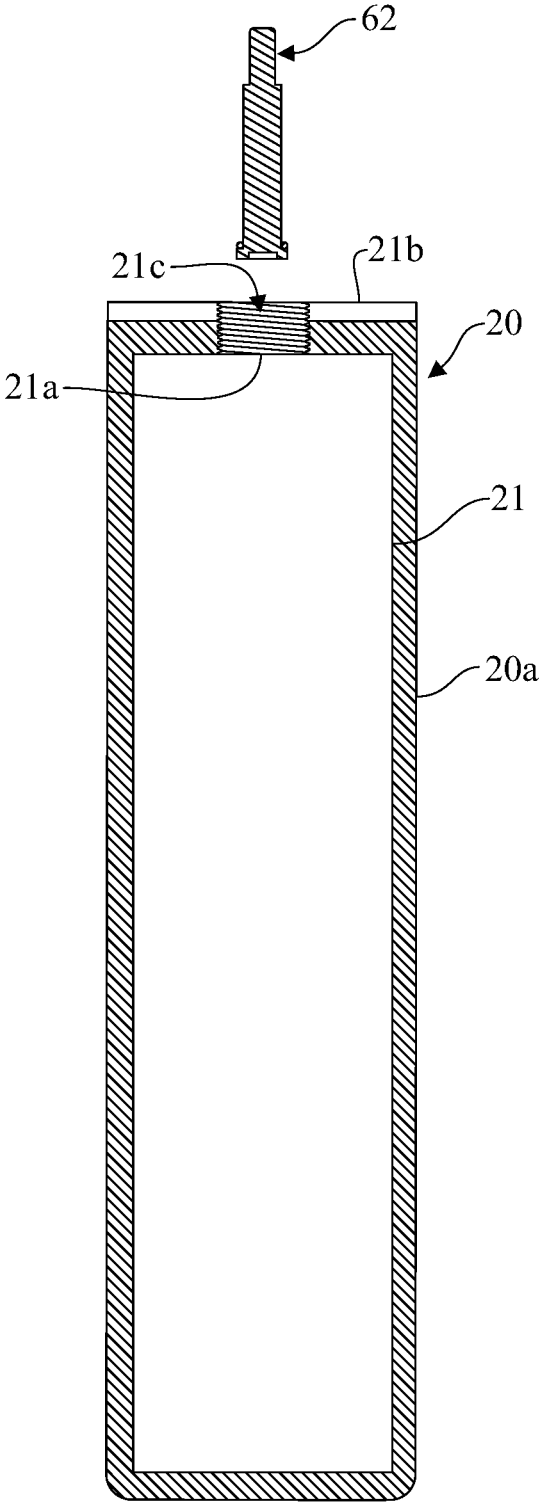
FIG. 6C is a partial exploded view of the battery and the threaded screw.

The present invention is an electric cigar lighter 10 as shown in at least FIGS. 8 through 12. Lighter 10 includes a battery portion 20 and a heating portion 22.

Battery portion 20 is a typical lithium ion cell rechargeable battery 21 within an outer casing 20*a* used in similar industries that is rechargeable from a USB (Universal Serial Bus) port and typically provides 3.8 volts, 20 amps and has a capacity of 2600 mAH (milliampere hour) when fully charged. Other batteries with different characteristics may be used. Battery 21 has a positive terminal 21*a* and a negative terminal 21*b*. Positive terminal 21*a* is within a recess 21*c* which receives and contacts the positive slotted head 68 of threaded screw 62. The battery portion 20 includes an on-off switch or push button 24 to activate the battery 21. This on-off switch is electrically connected on one side to the battery 21 and the other side to the positive and negative poles. To activate the battery 21, as is known in the industry, the button 24 must be pressed five (5) times, which is a safety factor to prevent inadvertent activation of the lighter 10. The battery portion 20 includes a receptacle 26 to connect to a USB cable (not shown) to connect the battery 21 to a source of electricity to charge the lithium ion battery. A charging LED light 28 is illuminated when the USB charging is taking place and the battery 21 is charging and may change color when the battery 21 is fully charged.

Heating portion 22 includes a main body portion 30 that is substantially cylindrical and has a diameter that is substantially the same as the battery portion 20. As seen in FIGS. 1A-1D, main body portion 30 has a through hole 32. Recess 21*c* has a female thread for receiving and fastening the threaded male connector 34 thus affixing the main body portion 30 to the battery portion 20. Main body portion 30 is cylindrical and has a shoulder 36 extending outwardly from peripheral wall 38 of main body portion 30. The wall portion 38*a* of peripheral wall 38 on the female receptacle 32 side of shoulder 36 is substantially cylindrical whereas the wall portion 38*b* of peripheral wall 38 on the male receptacle 34 side of shoulder 36 is conical or tapered inwardly from the shoulder 36 toward the male connector 34.

Cover 40 sits on peripheral wall 38 above flange 36 at cylindrical portion 38*a* with a friction fit. The cover 40 is a tubular sleeve having a circumferential wall. The circumferential wall of the cover 40 has vent openings 42 at opposing sides of cover 40 to allow air to flow into the internal area 44 of cover 40. A planar heating element 56 is disposed in said sleeve, the heating element 56 has an exposed face for engaging and lighting a cigar at the longitudinal end face of the cigar surface. The vent opening 42 is between said heating element and a second longitudinal end of the sleeve at the battery portion 20. The opening 42 is fluidically connected to an underside of the heating element 56. A continuous air gap is provided about a circumference of the heating element 56 between the heating element 56 and the circumferential wall.

Figure 7A:
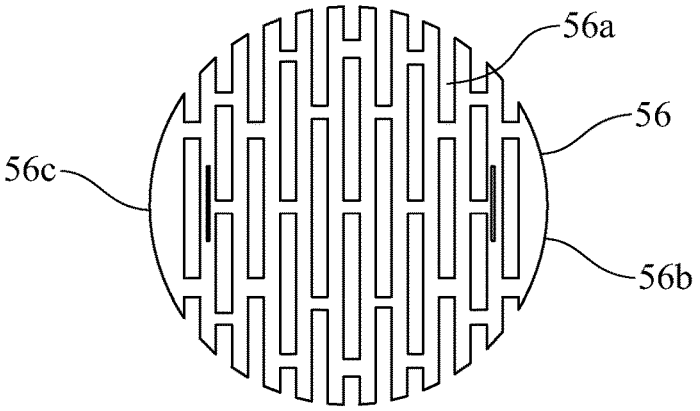
FIG. 7A is a top view of the resistor plate.
Figure 7B:
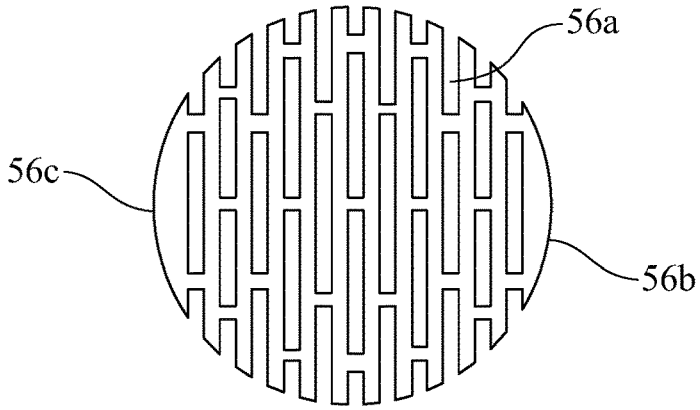
FIG. 7B is a bottom view of the resistor plate.
Figure 7C:
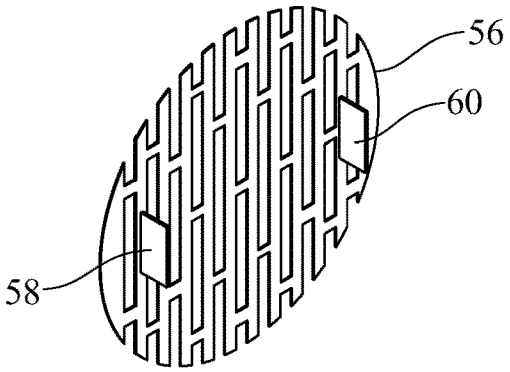
FIG. 7C is a bottom perspective view of the resistor plate.
Figure 7D:
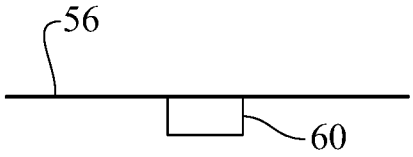
FIG. 7D is a side view of the resistor plate.
Figure 7E:
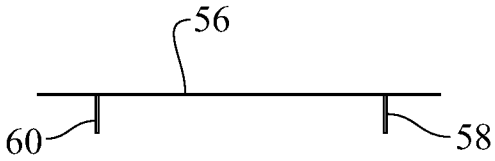
FIG. 7E is a front view of the resistor plate.
Figure 7F:
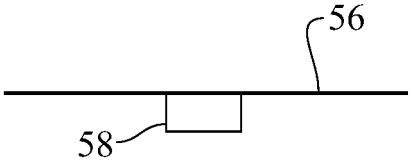
FIG. 7F is a side view of the resistor plate.
Figure 7G:
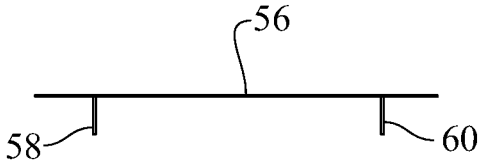
FIG. 7G is a rear view of the resistor plate.
Figure 7H:
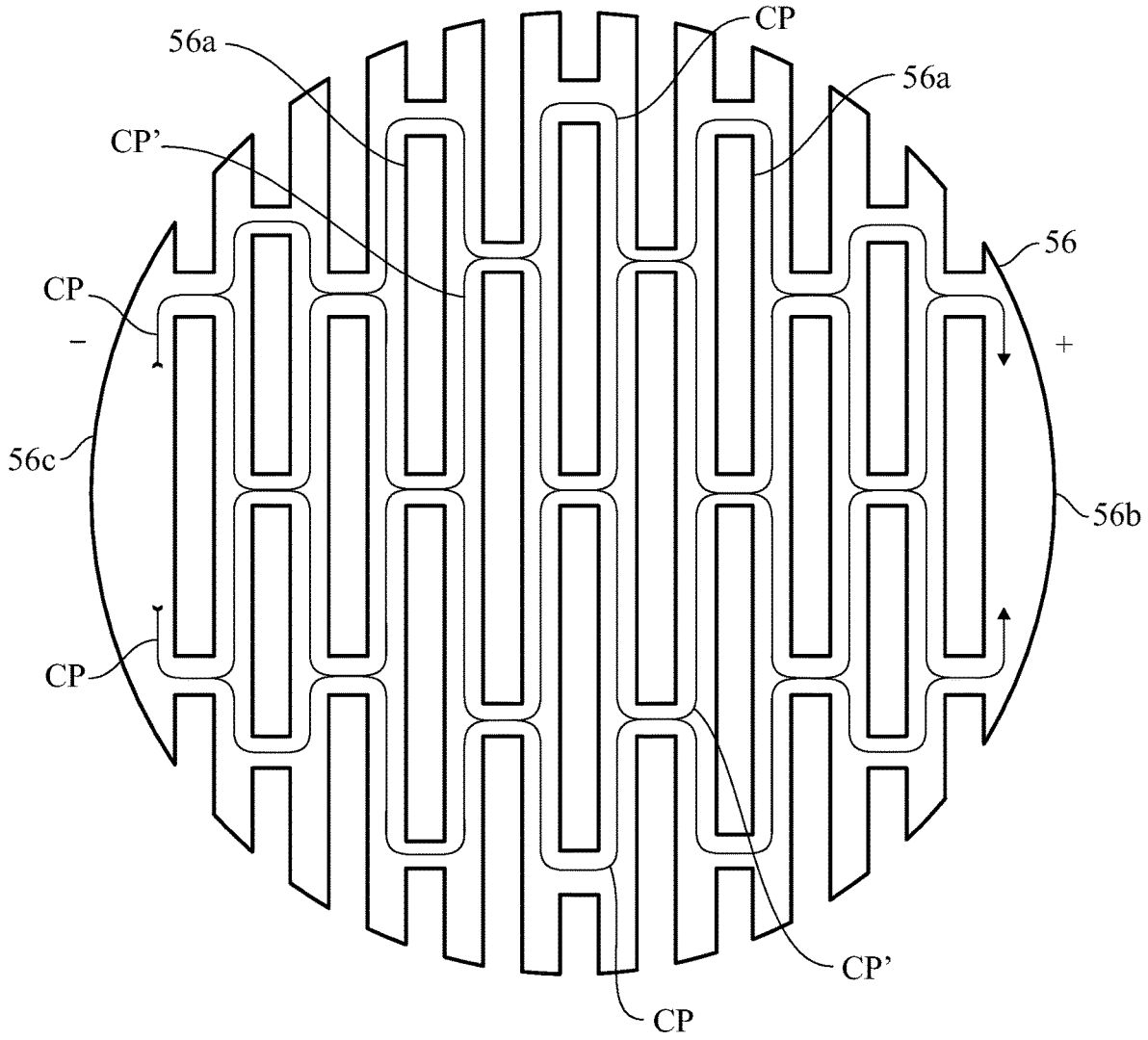
FIG. 7H is a plan view of the resistor plate showing current paths and locations of apertures in the resistor plate.
Figure 8:
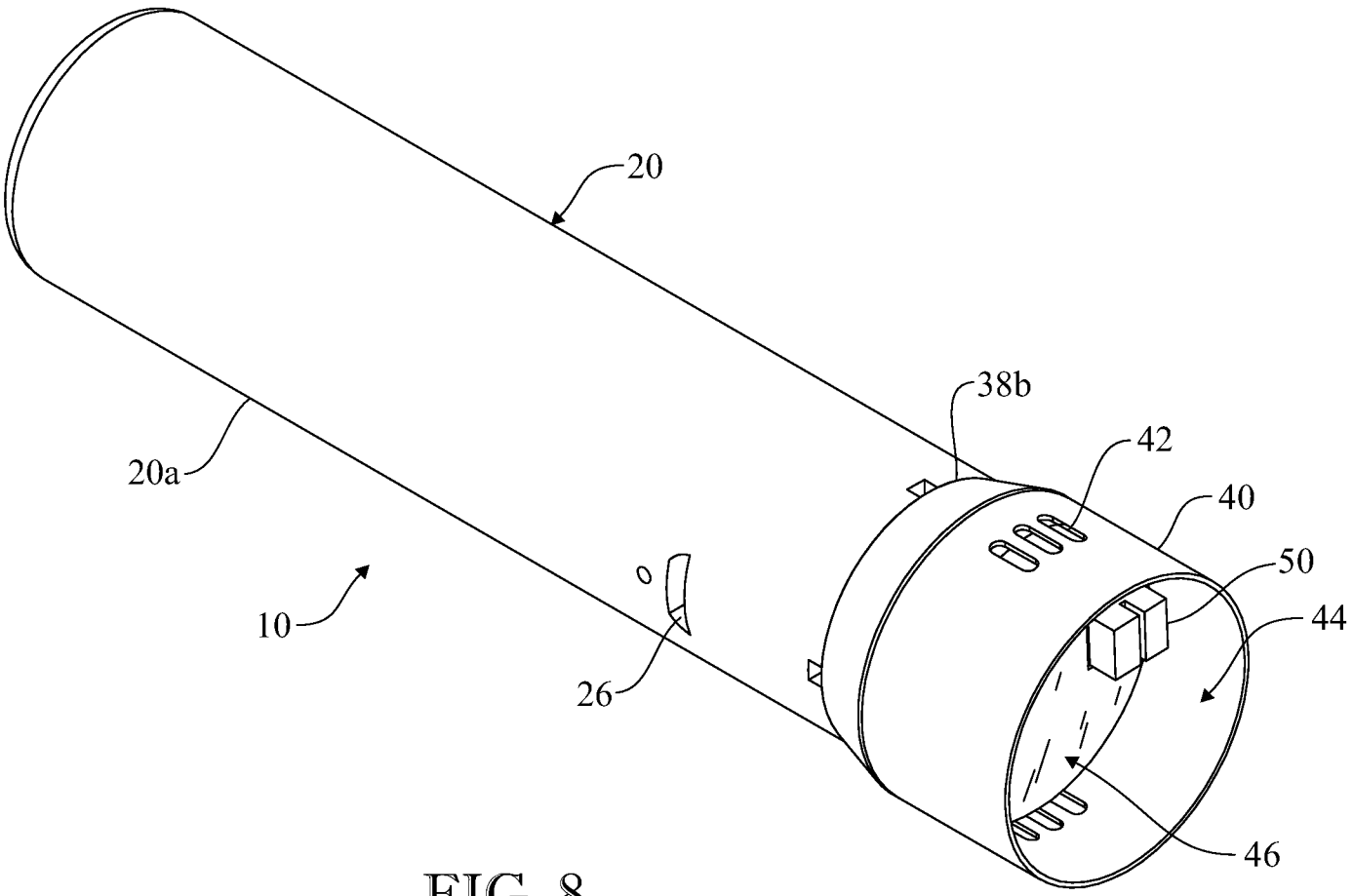
FIG. 8 is a front perspective view of the battery and the main body without the heating element/resistor plate.
Figure 9:
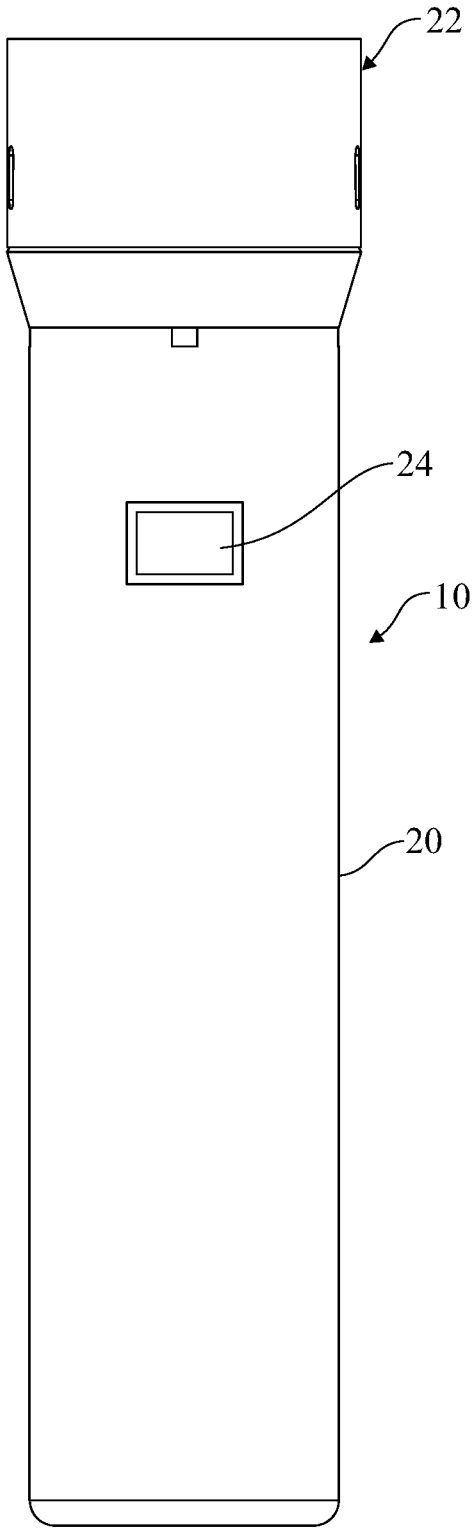
FIG. 9 is a side view of the battery and main body.
Figure 10:
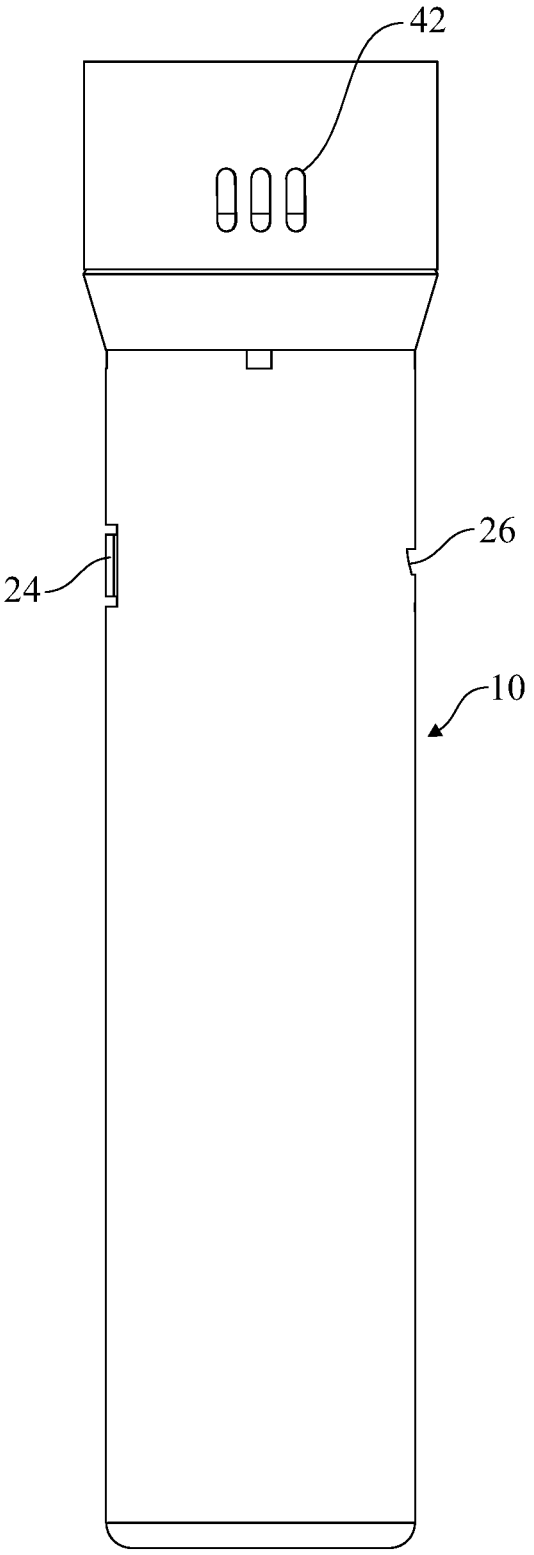
FIG. 10 is a side view of another side of the battery and main body.
Figure 11:
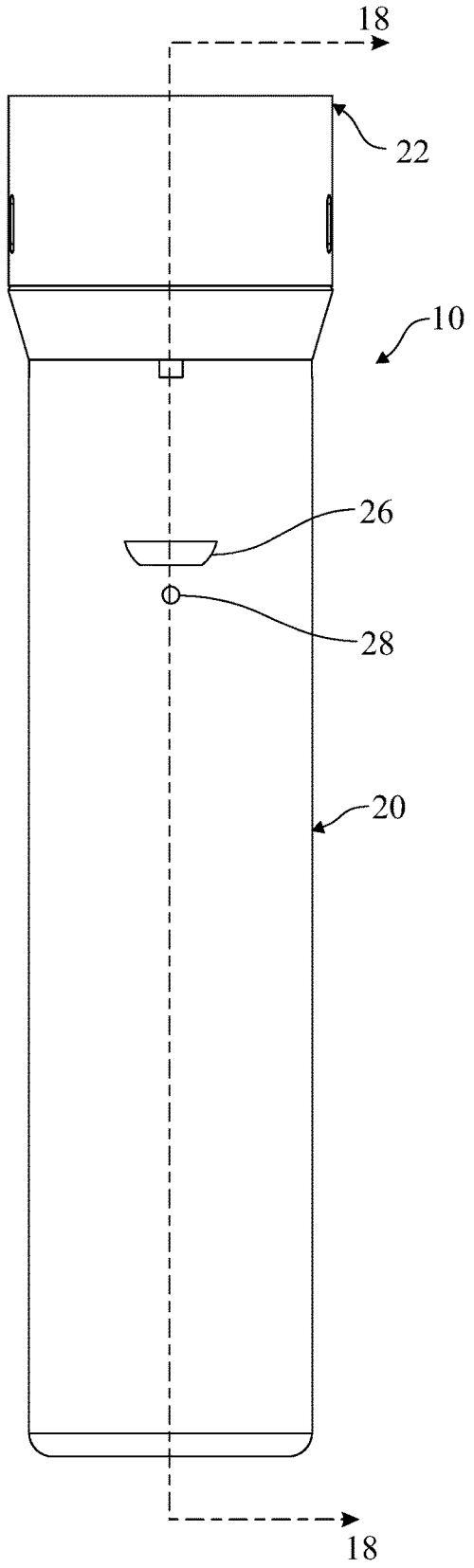
FIG. 11 is a side view of another side of the battery and main body.
Figure 12:
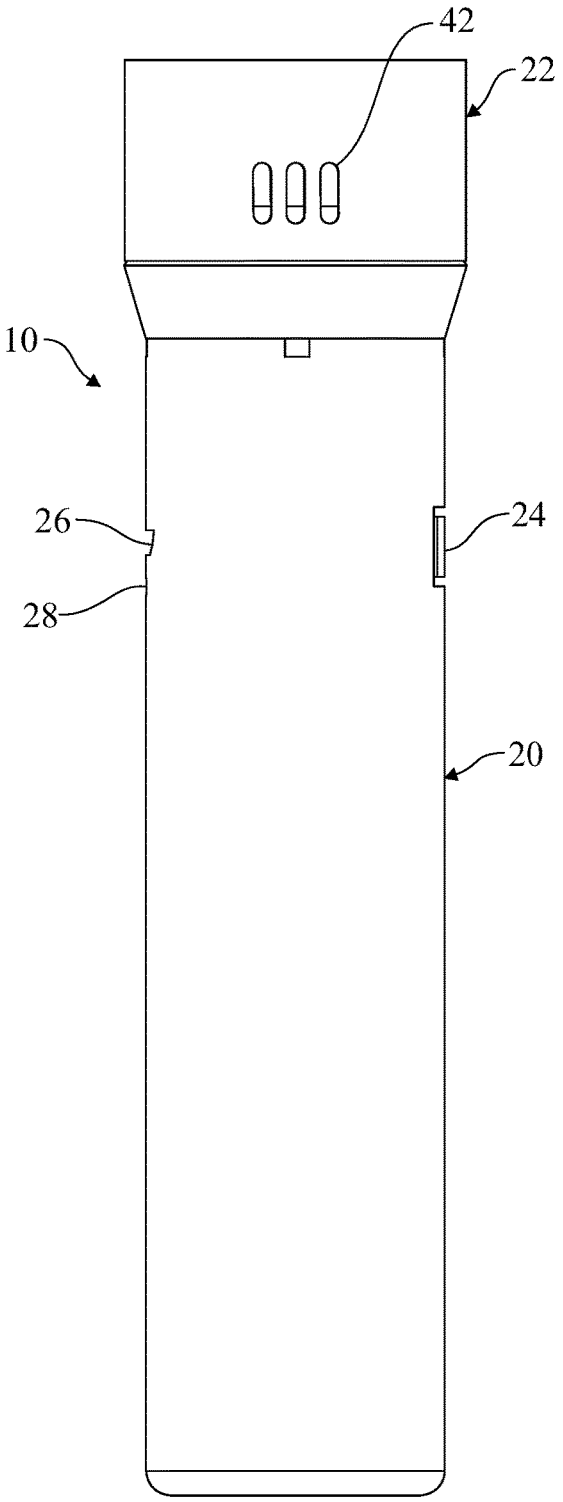
FIG. 12 is a side view of another side of the battery and main body.
Figure 13:
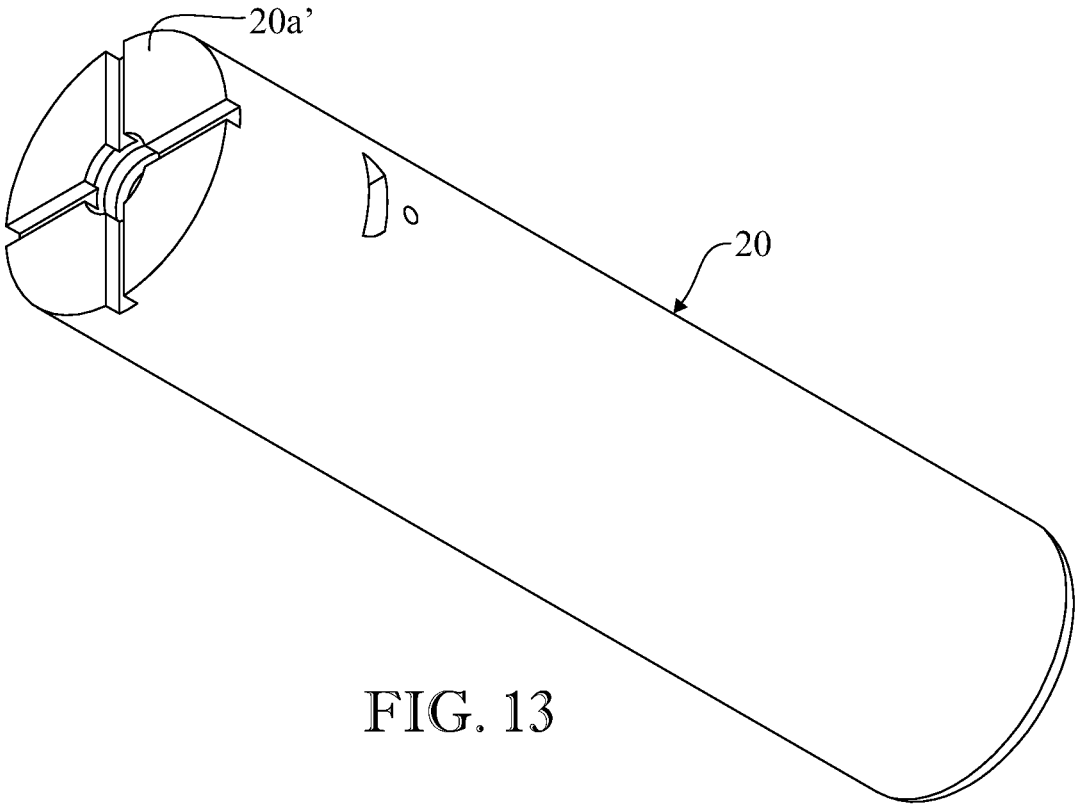
FIG. 13 is a front perspective view of the battery.
Figure 14:
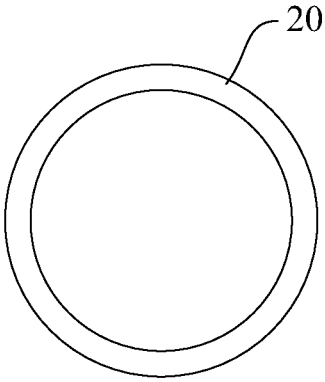
FIG. 14 is a bottom view of the battery.
Figure 15:
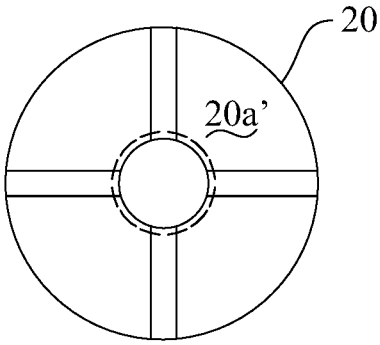
FIG. 15 is a top view of the battery.
Figure 16:
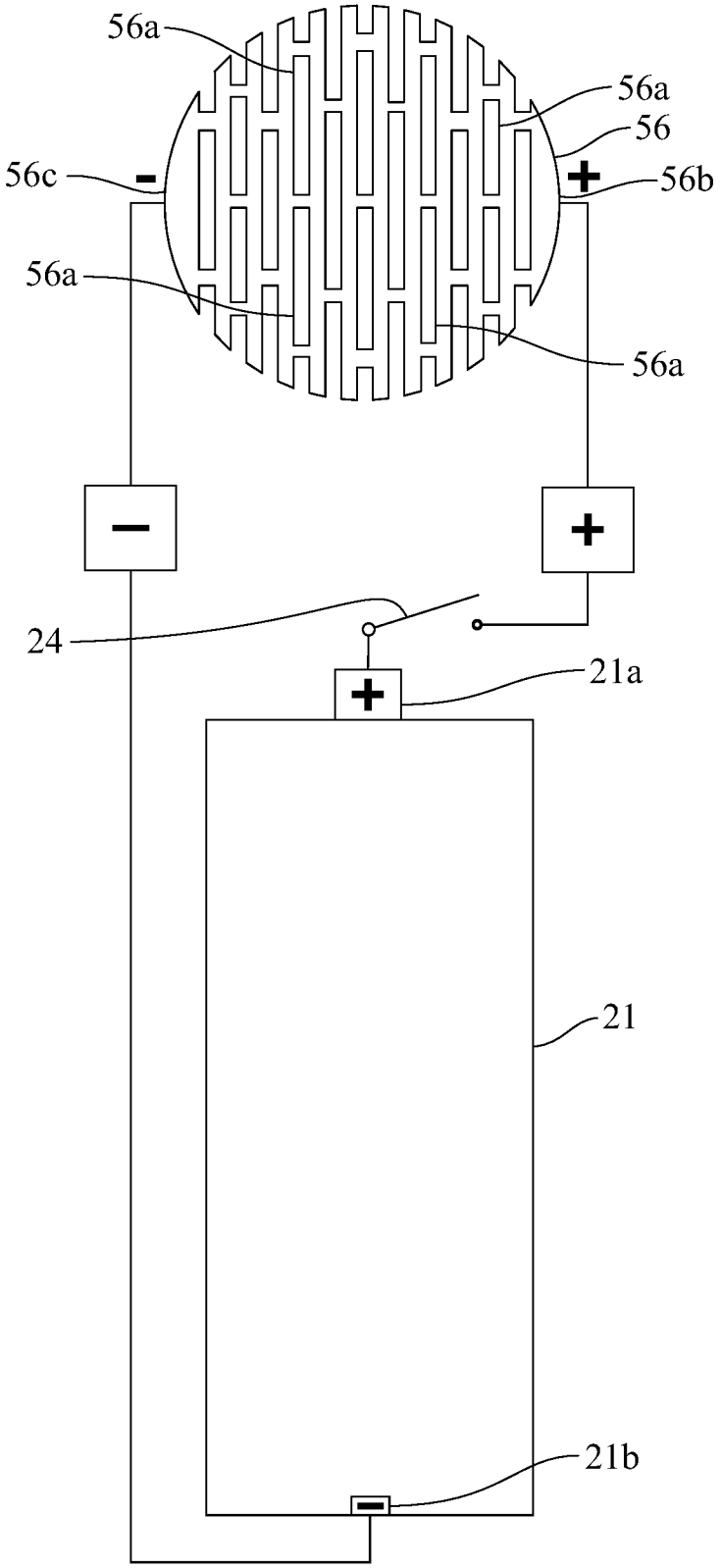
FIG. 16 is a schematic view of the battery, resistor plate, switch and the positive and negative terminals.

Within cover 40 and internal area 44 is a mounting surface 46, seen at FIG. 8, that supports various components of the heating portion 22. These various components include positive pole 48 that is electrically connected to the positive side of the battery 21, and negative pole 50 electrically connected to the negative side of the battery 21. Positive pole 48 has a slot 52 and a threaded opening 53. Negative pole 50 has a slot 54 and a cylindrical opening 55. Slots 52 and 54 connect to heating wire 56 by receiving with a friction fit flanges 58 and 60 respectively. The resistor plate 56 connects the positive pole 48 to the negative pole 50 and defines different current paths CP and CP', see FIG. 7H. The current paths CP can separate from one another at the poles and/or at a circumferential edge of said resistor plate 56.

The resistor plate 56 has a plurality of through apertures 56*a* formed therein, the plurality of apertures defining a plurality of adjacent current paths and corresponding heat paths between said first and second terminals, as seen in FIG. 7H. The apertures 56*a* may define a plurality of current paths CP, which can include a matched pair of current paths CP with a first half of said pair being symmetric to a second half of said pair about a line between the positive and negative poles 48 and 50 disposed 180° apart. The plurality of apertures 56*a* define a plurality of adjacent current paths CP between a positive pole 48 and a negative pole 50, which are disposed opposite one another 180° apart at the circumferential wall of the sleeve 40. The apertures 56*a* result in a grid pattern defining two primary current paths CP of equal length from the positive pole 48 to the negative pole 50 and secondary current paths CP' from the positive pole 48 to the negative pole 50, where a length of each of said two primary current paths CP is less than a length of the secondary current path CP'. The secondary current paths CP' may intersect either or both of the primary current paths CP over the course between the poles 48 and 50.

Furthermore, the through apertures 56*a* fluidically connect to the openings 42, which serves to provide air flow from an underside of the resistor plate 56 across the surface of the cigar. This in turn provides oxygen to the surface of the cigar and achieves an even lighting across an entire surface of the cigar. Accordingly, the inventors have discovered a synergistic relationship between the apertures 56*a* and current paths CP and CP', which results in an optimal cigar lighting experience.

Positive pole 48 is connected electrically to the battery 21 through a threaded screw 62, which has a threaded distal end 64, a smooth cylindrical medial portion 66 and at the proximal end, a slotted head 68. Threaded screw 62 fits through main body opening 33 but is not in electrical contact with main body 30. A washer 62*a* that seats under the slotted head 68 insulates threaded screw 62 from the main body 30 in order that the positive side of the battery 21 can contact and connect to positive pole 48. Insulating spacer 62*b* is disposed between positive pole 48 and main body 30 to insulate the positive pole 48 from the main body 30. The insulating spacer 62*b* has an aperture surrounded by a shoulder which surrounds and spaces the threaded screw 62 from the through hole 32 main body 30.

Negative pole 50 is electrically connected to the mounting surface 46 and main body portion 30 by a cylindrical steady pin 70 which fits at one end into cylindrical opening 57 and at the other end fits into pin location 31 on main body 30. Steady pin 70 also mechanically attaches negative pole 50 to main body portion 30. In this regard, main body 30 has a negative charge that is connected to the negative side of battery 21.

Heating wire or resistor plate 56 is a cylindrical relatively flat grill or burning plate, with multiple apertures or openings 56*a* on the surface of heating wire 56. Heating wire 56 has two opposed flanges 58 and 60 at the circumferential edges 56*b* and 56*c* of said heating wire 56 and at opposite sides of heating wire 56. These flanges 58 and 60 engage and connect to slots 52 and 54 to create a complete electrical circuit of the heating wire 56 and the battery 21 and the switch 24. The heating wire 56 is a high temperature wire that heats quickly. The heating wire 56 is made of a material FeCrAL which is an iron chromium aluminum mix without nickel. The resistance of the resistor plate 56 is 0.24 ohms.

The flanges 58 and 60 fit respectively into slots 52 and 54 of positive and negative poles 48 and 50. A battery circuit includes the battery 21, switch 24, threaded screw 62, positive pole 48, flange 58, heating wire 56, flange 60 negative pole 50, steady pin 70, main body portion 30, all connected in series. Thus when the on-off switch 24 is in the on position and current flows through the battery circuit, heating wire 56 will very quickly become heated because of the resistance of heating wire 56 and heating wire 56 will become sufficiently hot to ignite a substance, such as a cigar, in close proximity or touching heating wire 56. The vent openings 42 provide a source of air to the ignition area of heating wire 56 to promote combustion.

The heating wire 56 or resistor plate 56 defines a number of current paths for electrical current to pass through resistor plate 56. The current would flow through resistor plate 56 from the negative terminal to the positive terminal. The arrangement of the resistor plate thus allows a number of current paths CP and CP' because of the apertures 56*a* within the flat resistor plate 56.

Figure 17:
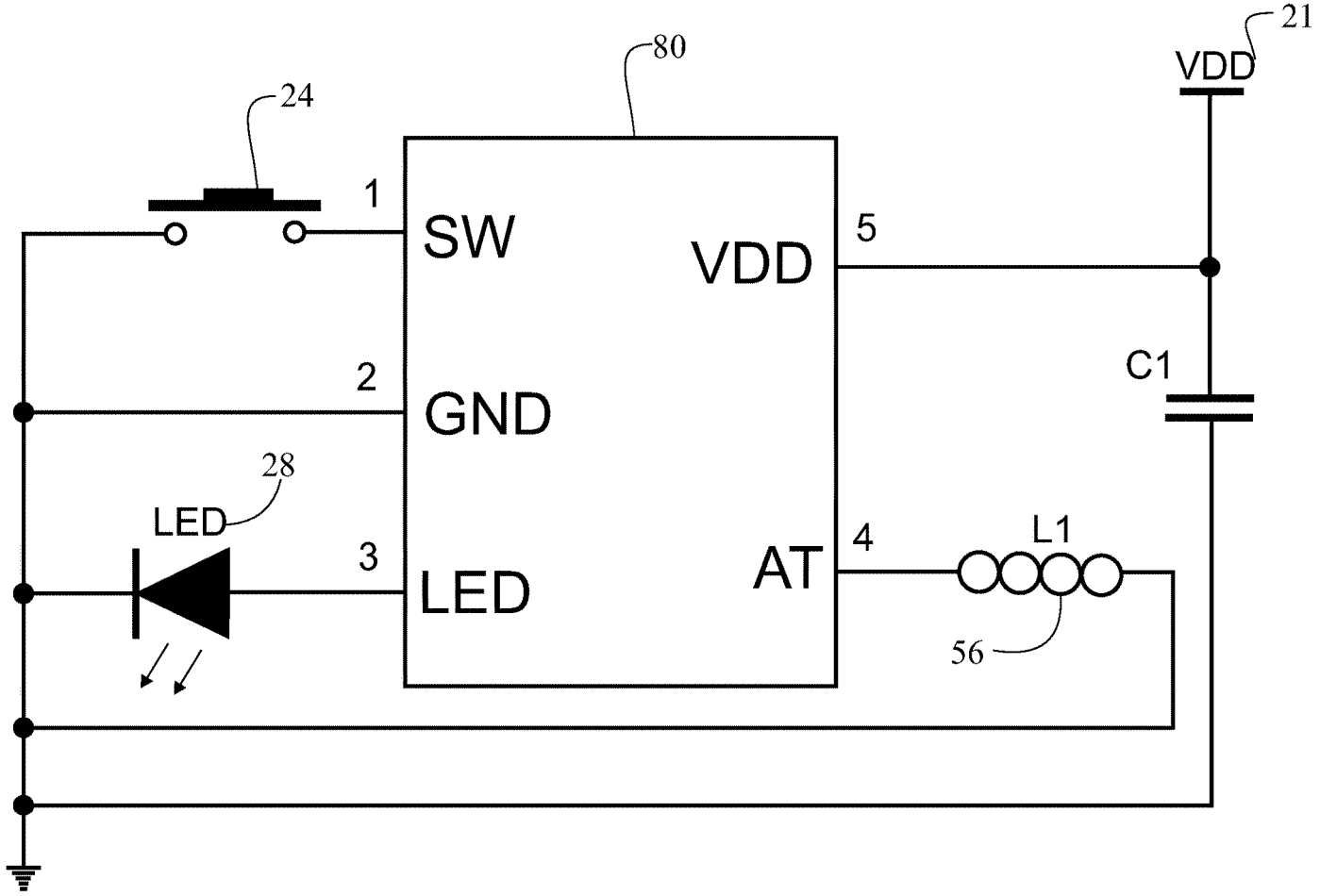
FIG. 17 is a circuit diagram of the logic board.

As shown in FIG. 17 is a logic board 80 which controls electronic functions of the cigar lighter 10. Diagramatically shown is switch (SW) 24, battery (VDD) 21, LED 28 and attached (AT) resistive plate 56. The functions of the logic board, substantially standard and known in industry includes an automatic shutoff after 10 seconds of continuous heating to prevent overheating; LED blink patterns which are standard and (indicate standby, lock, broken circuit, dying battery), and also allows the battery to be locked for transport with 5 simultaneous clicks of the push button switch 24 so the battery is in a safe mode. Likewise, the same 5 clicks are programmed in the logic circuit to unlock the battery so it is ready to use.

Figure 18:
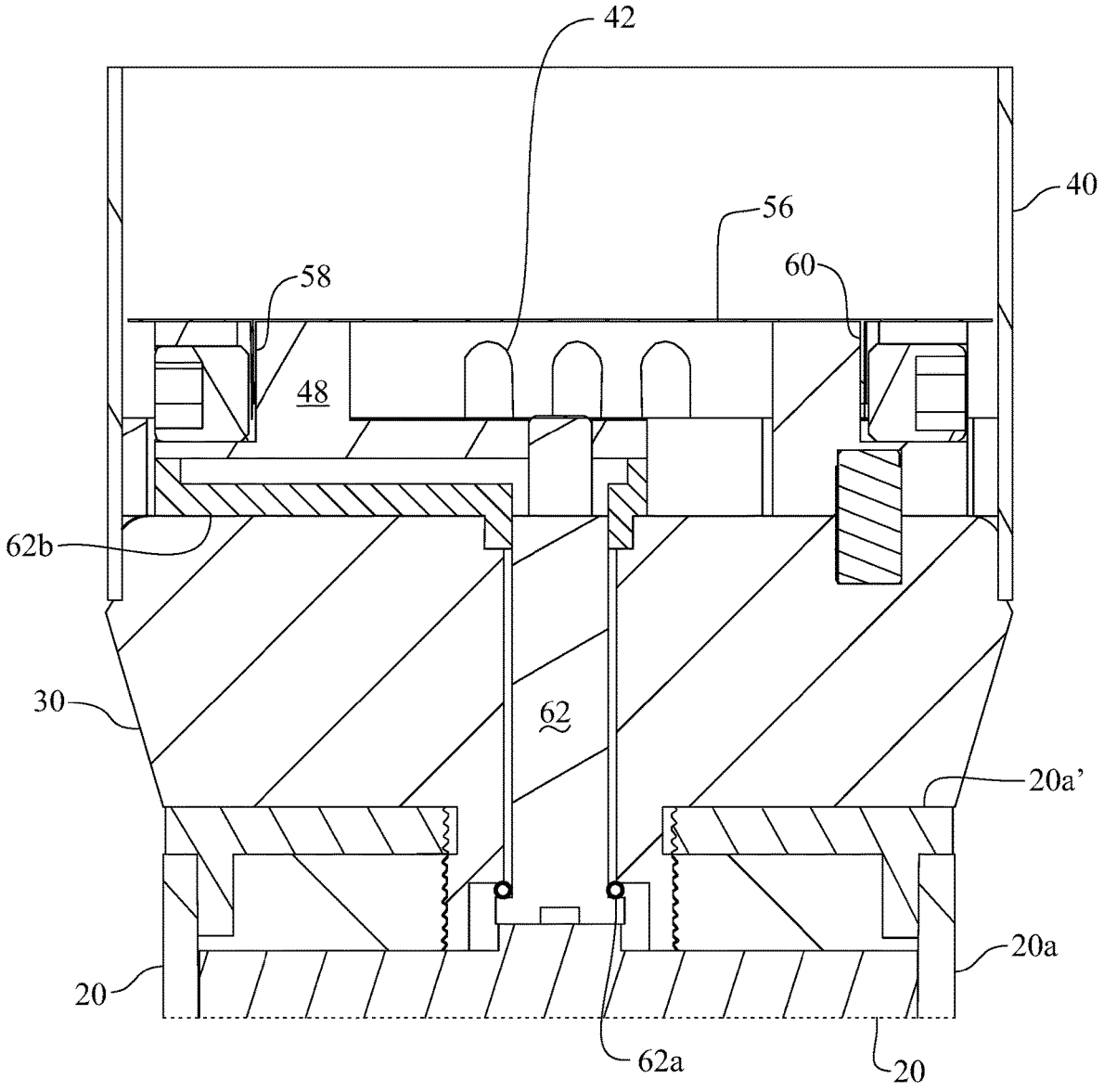
FIG. 18 is a cross sectional view of a portion of the cigar lighter taken from FIG. 11.

FIG. 18 shows a sectional view of the cigar lighter 10.

In summary, an electric cigar lighter for lighting a cigar having a battery attachable to a body portion, the body portion having a peripheral wall, the peripheral wall having a vent opening therein, a mounting plate within the peripheral wall and the body portion, the body portion having a cylindrical center opening there through; a positive pole having a slotted portion and an opening for receiving a threaded screw, the screw mounted through the cylindrical opening and electrically insulated from the mounting plate, and a negative pole having a slotted portion mounted on the mounting plate and separated from the positive pole; a heating wire having at a pair of separated flanges, one of the flanges connected to the slot in the positive pole and the other flange connected to the slot in the negative pole; and an electrical circuit connecting the battery, the switch, the positive pole, the heating wire and the negative pole in series, whereby when the electrical circuit is closed heat is generated by the heating wire.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A cigar lighter comprising:

a tubular body;

a sleeve;

an electrical power supply disposed in said body;

a resistor plate disposed in said sleeve and connected to said electrical power supply, said resistor plate defining a plurality of parallel circuits connected in series with one another, said resistor plate having two flanges;

said electrical power supply being electrically connected to a positive pole and a negative pole disposed within said sleeve, each of said poles having a slot formed therein for receiving a respective one of said two flanges for electrically connecting said resistor plate to said electrical power supply.

2. The cigar lighter according to claim 1, further comprising a main body having said positive pole and said negative pole and a screw connecting said positive pole to said main body and electrically connecting said positive pole to said power supply, said screw being electrically disconnected from said main body.

3. The cigar lighter according to claim 2, further comprising an electrically insulating spacer disposed between said positive pole and said main body for insulating said positive pole from said main body.

4. The cigar lighter according to claim 3, wherein said spacer spaces said screw from a through hole in said main body.

5. A cigar lighter comprising:

a sleeve having a circumferential wall, a first longitudinal end and a second longitudinal end;

a planar heating element disposed in said sleeve, said heating element having an exposed face for engaging and lighting a cigar;

an electrical power supply disposed within a cylindrical outer battery casing being coaxial with said sleeve at said second longitudinal end and being connected to said heating element;

said circumferential wall having an opening formed therein between said heating element and said second longitudinal end, said opening being fluidically connected to an underside of said heating element.

6. The cigar lighter according to claim 5, further comprising a continuous air gap about a circumference of said heating element between said heating element and said circumferential wall.

7. A cigar lighter comprising:

a cylindrical body having opposing longitudinal end faces;

a first pole;

a second pole;

an electrical power supply disposed in said cylindrical body;

a circular resistor plate connecting said first pole to said second pole, said circular resistor plate defining one of said opposing longitudinal end faces, said circular resistor plate defining a plurality of current paths separating from one another at said first and second poles.

8. A cigar lighter comprising:

a body;

a first pole;

a second pole;

a resistor plate having a circumferential edge, said resistor plate defining two opposing flanges at said circumferential edge, said resistor plate connecting said first pole to said second pole by said opposing flanges, said resistor plate defining a plurality of current paths between said first pole and said second pole, individual current paths of said plurality of current paths separating from one another at said opposing flanges.

9. A cigar lighter comprising:

a cylindrical body with a center axis;

a first pole;

a second pole opposite said first pole;

an electrical power supply disposed in said cylindrical body;

a circular resistor plate connecting said first pole to said second pole, said circular resistor plate having a plurality of through apertures formed therein, said plurality of apertures defining a plurality of adjacent current paths between said first and second poles, said apertures defining segments of each of said current paths, said segments having a longitudinal extent extending in a direction from said first pole to said second pole, said segments in a respective current path being offset laterally from directly adjacent segments of said segments in said respective current path.

10. A cigar lighter comprising:

a cylindrical body with a center axis;

an electrical power supply disposed in said cylindrical body;

a first pole disposed on said body;

a second pole disposed on said cylindrical body opposite said first pole and 180° from said first pole about said center axis;

a resistor plate having a matched pair of current paths with a first half of said pair being symmetric to a second half of said pair about a line through said center axis from said first pole to said second pole.

11. A cigar lighter comprising:

a body;

an electric power supply disposed in said body;

a first pole disposed on said body;

a second pole disposed on said body opposite said first pole;

a resistor plate having a circumferential edge, said resistor plate defining flanges disposed opposite one another at said circumferential edge, a first flange of said flanges engaging said first pole and a second flange of said flanges engaging said second pole, said resistor plate having parallel rows of longitudinally extending apertures formed therein, said apertures having a longitudinal extent extending transverse to a direction between said first pole and said second pole, said rows of longitudinally extending apertures defining a grid pattern defining two primary current paths of equal length from said first pole to said second pole and a secondary current path from said first pole to said second pole, a length of each of said two primary current paths being less than a length of said secondary current path.

12. The cigar lighter according to claim 1, wherein said resistor plate is circular.

13. The cigar lighter according to claim 10, wherein said first and second poles are disposed at an outer circumferential edge of said resistor plate.

14. The cigar lighter according to claim 11, wherein said resistor plate is circular.

15. A cigar lighter comprising:

a cylindrical battery body portion having a battery disposed therein;

a heating portion having a cylindrical main body and a circular resistor plate mounted on said main body, said cylindrical main body being coaxially mounted on said cylindrical battery body portion and electrically connecting said resistor plate to said battery;

a cylindrical sleeve mounted on said cylindrical main body, said circular resistor plate being disposed inside said cylindrical sleeve within an extent of said cylindrical sleeve and said circular resistor plate having a circumferential edge being spaced from an inner wall surface of said cylindrical sleeve about an entire circumference of said circular resistor plate.

16. The cigar lighter according to claim 15, wherein said cylindrical main body is releasably connected to said cylindrical battery body portion by a threaded connection.

17. The cigar lighter according to claim 11, wherein an aperture of a first row of parallel rows of longitudinally extending apertures overlaps two apertures of an adjacent row of said parallel rows of longitudinally extending apertures in along a longitudinal extent of said parallel rows of longitudinally extending apertures.

* * * * *